US009261835B2

(12) United States Patent
Kawarasaki et al.

(10) Patent No.: US 9,261,835 B2
(45) Date of Patent: Feb. 16, 2016

(54) FIXING DEVICE AND IMAGE FORMING APPARATUS

(71) Applicants: Yasuharu Kawarasaki, Hyogo (JP); Tomoya Adachi, Osaka (JP); Yutaka Naitoh, Hyogo (JP); Hitoshi Fujiwara, Osaka (JP); Masahiro Samei, Osaka (JP)

(72) Inventors: Yasuharu Kawarasaki, Hyogo (JP); Tomoya Adachi, Osaka (JP); Yutaka Naitoh, Hyogo (JP); Hitoshi Fujiwara, Osaka (JP); Masahiro Samei, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/719,506

(22) Filed: May 22, 2015

(65) Prior Publication Data

US 2015/0346662 A1 Dec. 3, 2015

(30) Foreign Application Priority Data

Jun. 3, 2014 (JP) ..... 2014-114646

(51) Int. Cl.
*G03G 15/00* (2006.01)
*G03G 15/20* (2006.01)

(52) U.S. Cl.
CPC ..... *G03G 15/2053* (2013.01)

(58) Field of Classification Search
CPC ..... G03G 15/2053; G03G 15/2064; G03G 15/2017; G03G 15/2039; G03G 15/2025; G03G 2215/2035; G03G 2215/0129
USPC ..... 399/329
See application file for complete search history.

(56) References Cited

U.S. PATENT DOCUMENTS

| | | | |
|---|---|---|---|
| 2008/0056783 | A1 | 3/2008 | Yamamoto et al. |
| 2009/0060572 | A1 | 3/2009 | Naitoh et al. |
| 2009/0074440 | A1 | 3/2009 | Nanno et al. |
| 2010/0034548 | A1 | 2/2010 | Naitoh et al. |
| 2010/0232848 | A1 | 9/2010 | Naitoh |
| 2011/0026944 | A1 | 2/2011 | Naitoh |
| 2011/0206427 | A1 | 8/2011 | Iwaya et al. |
| 2011/0299899 | A1 | 12/2011 | Ishigaya et al. |
| 2012/0020681 | A1 | 1/2012 | Naitoh et al. |

(Continued)

FOREIGN PATENT DOCUMENTS

| | | |
|---|---|---|
| JP | 2006-251068 | 9/2006 |
| JP | 2011-069940 | 4/2011 |
| JP | 2011-175168 | 9/2011 |

OTHER PUBLICATIONS

U.S. Appl. No. 14/602,766, filed Jan. 22, 2015.

(Continued)

*Primary Examiner* — Walter L Lindsay, Jr.
*Assistant Examiner* — Jessica L Eley
(74) *Attorney, Agent, or Firm* — Harness, Dickey & Pierce, P.L.C.

(57) ABSTRACT

A fixing device includes an endless belt rotatable in a given direction of rotation and a thermal conductor to conduct heat from a heater to the endless belt. A pressure rotator is pressed against the endless belt to form a fixing nip therebetween. An abutment contacts the endless belt to restrict a trajectory of the endless belt to bring the endless belt into contact with the thermal conductor in a particular circumferential span spanning from a particular position upstream from the fixing nip to the fixing nip in the direction of rotation of the endless belt and to separate the endless belt from the thermal conductor in at least a part of an outboard circumferential span outboard from the particular circumferential span in the direction of rotation of the endless belt.

19 Claims, 6 Drawing Sheets

(56) References Cited

U.S. PATENT DOCUMENTS

| | | | | |
|---|---|---|---|---|
| 2012/0093532 | A1 | 4/2012 | Ishigaya et al. | |
| 2012/0093534 | A1 | 4/2012 | Waida et al. | |
| 2012/0148287 | A1 | 6/2012 | Samei et al. | |
| 2012/0148317 | A1 | 6/2012 | Samei et al. | |
| 2012/0177422 | A1 | 7/2012 | Nanno et al. | |
| 2012/0243895 | A1 | 9/2012 | Samei et al. | |
| 2012/0275834 | A1 | 11/2012 | Naitoh et al. | |
| 2013/0051876 | A1 | 2/2013 | Ishigaya et al. | |
| 2013/0064586 | A1 | 3/2013 | Adachi et al. | |
| 2013/0266355 | A1* | 10/2013 | Yoshiura | G03G 15/2017 399/329 |
| 2013/0272760 | A1* | 10/2013 | Oohara | G03G 15/2085 399/329 |
| 2013/0308990 | A1 | 11/2013 | Samei at al. | |
| 2014/0056625 | A1 | 2/2014 | Naitoh et al. | |
| 2014/0072354 | A1 | 3/2014 | Toyoda et al. | |
| 2014/0093288 | A1 | 4/2014 | Naitoh et al. | |
| 2014/0099138 | A1 | 4/2014 | Ishigaya et al. | |
| 2014/0099146 | A1 | 4/2014 | Fujii et al. | |
| 2014/0112691 | A1 | 4/2014 | Nanno et al. | |
| 2014/0133877 | A1 | 5/2014 | Samei et al. | |
| 2014/0153982 | A1 | 6/2014 | Adachi et al. | |
| 2014/0153983 | A1 | 6/2014 | Fuji et al. | |
| 2014/0219673 | A1 | 8/2014 | Yamamoto et al. | |
| 2014/0219696 | A1 | 8/2014 | Fujimoto at al. | |
| 2015/0071688 | A1 | 3/2015 | Yamaguchi et al. | |
| 2015/0078768 | A1 | 3/2015 | Yamaguchi et al. | |

OTHER PUBLICATIONS

U.S. Appl. No. 14/609,028, filed Jan. 29, 2015.

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2014-114646, filed on Jun. 3, 2014, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a heating rotator, such as a fixing roller, a fixing belt, and a fixing film, heated by a heater and a pressure rotator, such as a pressure roller and a pressure belt, pressed against the heating rotator to form a fixing nip therebetween through which a recording medium bearing a toner image is conveyed. As the recording medium bearing the toner image is conveyed through the fixing nip, the heating rotator and the pressure rotator apply heat and pressure to the recording medium, melting and fixing the toner image on the recording medium.

SUMMARY

At least one embodiment provides a novel fixing device that includes an endless belt formed into a loop and rotatable in a given direction of rotation and a heater disposed opposite the endless belt to heat the endless belt. A thermal conductor is interposed between the heater and the endless belt to conduct heat from the heater to the endless belt and guide the endless belt. A pressure rotator is pressed against the endless belt to form a fixing nip therebetween, through which a recording medium is conveyed. An abutment contacts the endless belt to restrict a trajectory of the endless belt to bring the endless belt into contact with the thermal conductor in a particular circumferential span spanning from a particular position upstream from the fixing nip to the fixing nip in the direction of rotation of the endless belt and to separate the endless belt from the thermal conductor in at least a part of an outboard circumferential span outboard from the particular circumferential span in the direction of rotation of the endless belt.

At least one embodiment provides a novel image forming apparatus that includes an image forming device to form a toner image and a fixing device disposed downstream from the image forming device in a recording medium conveyance direction to fix the toner image on a recording medium. The fixing device includes an endless belt formed into a loop and rotatable in a given direction of rotation and a heater disposed opposite the endless belt to heat the endless belt. A thermal conductor is interposed between the heater and the endless belt to conduct heat from the heater to the endless belt and guide the endless belt. A pressure rotator is pressed against the endless belt to form a fixing nip therebetween, through which the recording medium is conveyed. An abutment contacts the endless belt to restrict a trajectory of the endless belt to bring the endless belt into contact with the thermal conductor in a particular circumferential span spanning from a particular position upstream from the fixing nip to the fixing nip in the direction of rotation of the endless belt and to separate the endless belt from the thermal conductor in at least a part of an outboard circumferential span outboard from the particular circumferential span in the direction of rotation of the endless belt.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
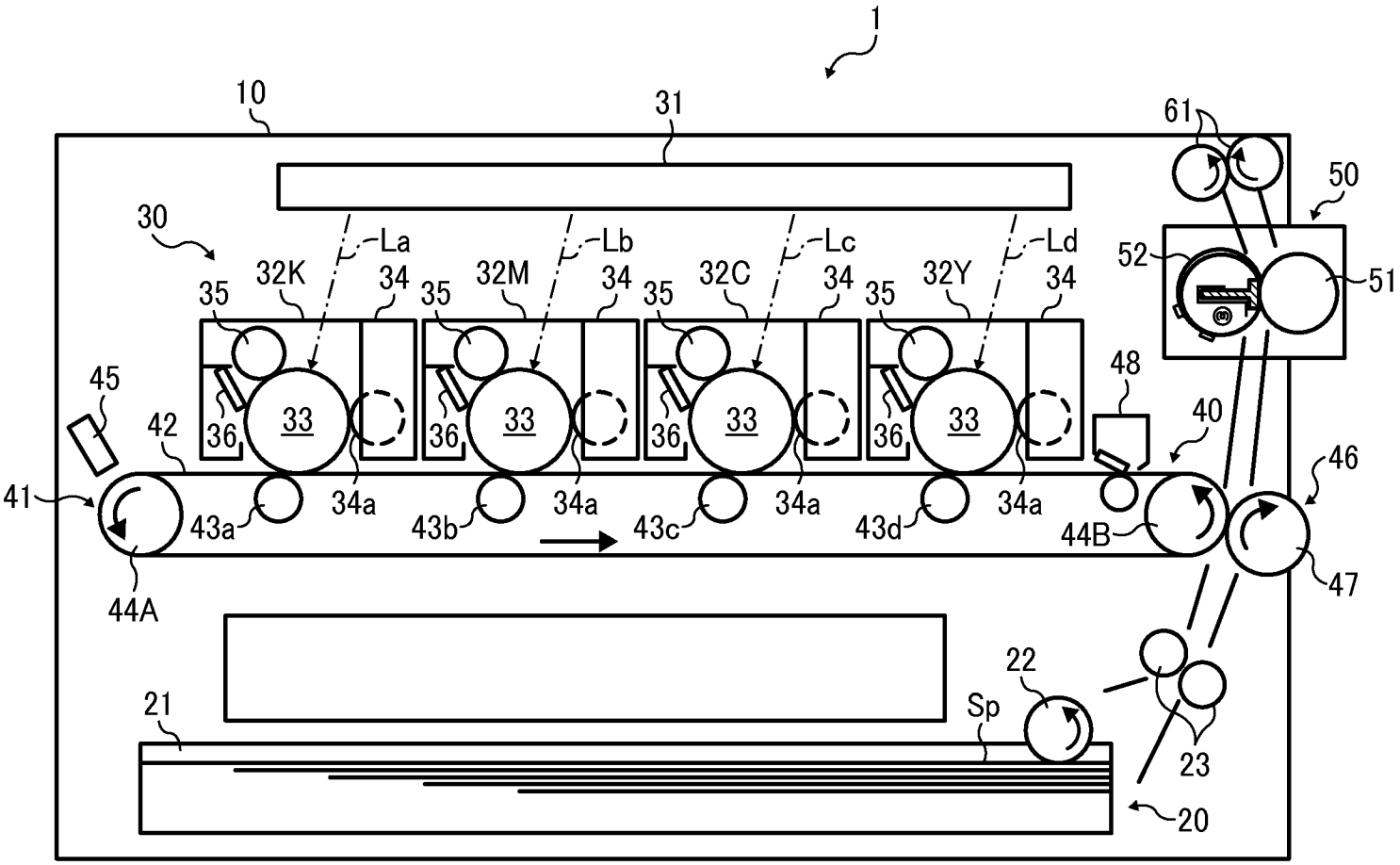
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to"

another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a color printer that forms color and monochrome toner images on recording media by electrophotography. Alternatively, the image forming apparatus 1 may be a monochrome printer that forms monochrome toner images.

With reference to FIG. 1, a description is provided of a construction of the image forming apparatus 1.

The image forming apparatus 1 is a tandem color image forming apparatus that performs a primary transfer and a secondary transfer of a toner image. The image forming apparatus 1 includes a sheet feeder 20, an image forming device 30, a transfer device 40, and a fixing device 50.

A detailed description is now given of a construction of the sheet feeder 20.

The sheet feeder 20 includes at least one paper tray 21 that loads a plurality of sheets Sp (e.g., transfer sheets and recording sheets) serving as recording media layered on the paper tray 21. The plurality of sheets Sp having a given size loaded on the paper tray 21 is oriented in a portrait orientation or a landscape orientation.

The sheet feeder 20 further includes a feed roller 22 and a registration roller pair 23. The feed roller 22 is disposed opposite an uppermost sheet Sp of the plurality of sheets Sp placed on the paper tray 21. The registration roller pair 23 is disposed downstream from the feed roller 22 in a sheet conveyance direction. The feed roller 22 picks up and feeds the uppermost sheet Sp to the registration roller pair 23. The registration roller pair 23 conveys the transfer sheet Sp to the transfer device 40 according to an operation status of the image forming device 30 and the transfer device 40 and controls the conveyance time and the conveyance speed of the transfer sheet Sp. A detailed description thereof is deferred.

A detailed description is now given of a construction of the image forming device 30.

The image forming device 30 includes an exposure device 31 located in an upper portion of a body 10 of the image forming apparatus 1 and four process units 32K, 32M, 32C, and 32Y aligned in this order from left to right in FIG. 1.

The exposure device 31 emits light, for example, laser beams La, Lb, Lc, and Ld, to expose the process units 32K, 32M, 32C, and 32Y to optically write electrostatic latent images according to image data created by reading an image on an original by an image scanner or sent from an external device (e.g., a client computer) as an image forming process of each of the process units 32K, 32M, 32C, and 32Y progresses. For example, the exposure device 31 includes a laser beam scanner using a laser diode. Alternatively, the exposure device 31 may include a light-emitting element such as a light-emitting diode (LED).

The process units 32K, 32M, 32C, and 32Y form toner images in different colors, that is, black, magenta, cyan, and yellow toner images, respectively. However, the process units 32K, 32M, 32C, and 32Y have substantially an identical construction. Each of the process units 32K, 32M, 32C, and 32K includes a tubular photoconductive drum 33, a developing device 34, a charger 35, and a cleaning blade 36.

The photoconductive drum 33 includes a surface layer made of an organic photoreceptor, for example. The photoconductive drum 33 is driven and rotated such that the surface layer rotates at a given linear velocity. After the charger 35 electrostatically charges the surface layer of the photoconductive drum 33 uniformly, the exposure device 31 exposes the photoconductive drum 33 with the laser beam La, Lb, Lc, or Ld. As the laser beams La, Lb, Lc, and Ld decrease the electric potential of an exposed portion of the photoconductive drum 33, an electrostatic latent image is formed on the photoconductive drum 33 according to the image data created by the image scanner or sent from the external device.

The developing device 34 includes a developing roller 34*a* disposed in proximity to the photoconductive drum 33. The developing device 34 contains a developer (e.g., toner particles) that comes into contact with the developing roller 34*a*. The developing roller 34*a* bears a substantially thin toner layer made of charged fine toner particles. A high voltage power supply applies a given developing bias voltage to the developing roller 34*a* according to the electric potential of the charged photoconductive drum 33. The developer may be a one-component developer or a two-component developer.

The charger 35 includes a charging roller applied with a charging bias, for example. The charger 35 presses against an outer circumferential surface of the photoconductive drum 33 to rotate in accordance with rotation of the photoconductive drum 33. The high voltage power supply applies a bias voltage produced by a direct current (DC) or an alternating current (AC) superimposed on the direct current to the charger 35, thus uniformly charging the outer circumferential surface of the photoconductive drum 33 at a given surface electric potential. According to this example embodiment, the charger 35 includes the charging roller that is applied with the charging bias and rotates while contacting the photoconductive drum 33. Alternatively, the charger 35 may include a scorotron charger that charges the photoconductive drum 33 without contacting the photoconductive drum 33.

The photoconductive drum 33 uniformly charged at the given surface electric potential by the charger 35, when it is exposed through optical writing performed by the exposure device 31, bears an electrostatic latent image. As the electrostatic latent image formed on the photoconductive drum 33 travels through a developing nip formed between the photoconductive drum 33 and the developing roller 34*a* of the developing device 34, the developing roller 34*a* develops the electrostatic latent image into a toner image (e.g., black, magenta, cyan, and yellow toner images). For example, the toner particles producing the thin toner layer on the developing roller 34*a* move onto the electrostatic latent image formed on the photoconductive drum 33, visualizing the electrostatic latent image into the toner image.

The image forming device 30 performs an optical writing process for each of the black, magenta, cyan, and yellow toner images conducted by the exposure device 31 and an electrophotographic process for each of the black, magenta, cyan, and yellow toner images conducted by the four process units 32K, 32M, 32C, and 32Y according to superimposition of the black, magenta, cyan, and yellow toner images to form a composite toner image and the order of primary transfer of the black, magenta, cyan, and yellow toner images from the image forming device 30 to the transfer device 40.

The cleaning blade 36 includes a plate made of polyurethane rubber or the like, for example. A tip of the cleaning blade 36 is pressed against the photoconductive drum 33. The cleaning blade 36 scrapes residual toner particles failed to be transferred onto the transfer device 40 and therefore remaining on the photoconductive drum 33 thereoff as the photoconductive drum 33 rotates, thus removing the residual toner particles from the photoconductive drum 33. Alternatively, the cleaning blade 36 may be eliminated and the developing device 34 may collect the residual toner particles from the photoconductive drum 33. Yet alternatively, instead of the cleaning blade 36, an arbitrary cleaner may be disposed opposite the photoconductive drum 33 to remove the residual toner particles from the photoconductive drum 33.

A detailed description is now given of a construction of the transfer device 40.

The transfer device 40 includes a primary transferor 41 and a secondary transferor 46. The primary transferor 41 is disposed opposite the photoconductive drum 33 of each of the process units 32K, 32M, 32C, and 32Y. The primary transferor 41 includes an endless transfer belt 42 formed into a movable loop; a plurality of primary transfer rollers 43*a*, 43*b*, 43*c*, and 43*d*, a tension roller 44A, and a driving roller 44B disposed inside the loop formed by the transfer belt 42; and a toner mark sensor 45. The secondary transferor 46 includes a secondary transfer roller 47 abutting the transfer belt 42 and a belt cleaner 48 that cleans the transfer belt 42 after the secondary transfer.

The transfer belt 42 is stretched taut across the tension roller 44A and the driving roller 44B extending parallel to the tension roller 44A. A driving motor drives and rotates the driving roller 44B which in turn rotates the transfer belt 42.

The plurality of primary transfer rollers 43*a*, 43*b*, 43*c*, and 43*d* is pressed against the plurality of photoconductive drums 33, respectively, via the transfer belt 42 rotating counterclockwise in FIG. 1. Accordingly, four primary transfer nips are formed between the four photoconductive drums 33 and the transfer belt 42. At the primary transfer nips, the primary transfer rollers 43*a*, 43*b*, 43*c*, and 43*d* situated inside the loop formed by the transfer belt 42 press the transfer belt 42 against the photoconductive drums 33, respectively. The single power supply applies a given transfer bias, for example, a transfer bias voltage in a range of from about 400 V to about 2,500 V, to the primary transfer rollers 43*a*, 43*b*, 43*c*, and 43*d* used for the primary transfer, thus producing a transfer electric field.

Accordingly, a primary transfer electric field that electrostatically transfers the toner image formed on the photoconductive drum 33 onto the transfer belt 42 is produced at each primary transfer nip.

As the transfer belt 42 rotates counterclockwise in FIG. 1 and moves through the four primary transfer nips, the yellow, cyan, magenta, and black toner images formed on the four photoconductive drums 33, respectively, are primarily transferred onto an outer circumferential surface of the transfer belt 42 at the primary transfer nips successively such that the yellow, cyan, magenta, and black toner images are superimposed on a same position on the transfer belt 42. Accordingly, the outer circumferential surface of the transfer belt 42 bears a composite toner image produced by superimposition of the yellow, cyan, magenta, and black toner images.

Alternatively, toner images in a plurality of colors may be formed on the transfer belt 42 with an identical interval between the adjacent toner images in a circumferential direction of the transfer belt 42 and the toner images may be transferred onto a sheet Sp such that the toner images are superimposed on a same position on the sheet Sp to form a color toner image on the sheet Sp. Yet alternatively, a monochrome toner image may be formed on the outer circumferential surface of the transfer belt 42.

A biasing member (e.g., a spring) biases the tension roller 44A at both lateral ends of the tension roller 44A in an axial direction thereof against the transfer belt 42 to exert tension to the transfer belt 42. A driving motor drives and rotates the driving roller 44B at a linear velocity (e.g., a circumferential speed) corresponding to that of the photoconductive drum 33.

The toner mark sensor 45 includes a specular reflection or diffuse sensor that detects a toner mark used to detect color shift. Based on a detection result from the toner mark sensor 45, the density and the position of each of the yellow, cyan, magenta, and black toner images formed on the transfer belt 42 are measured to adjust the density of those toner images and correct color shift.

The composite toner image, that is, the color toner image, formed on the transfer belt 42 approaches the secondary transfer roller 47 of the secondary transferor 46 as the transfer belt 42 rotates. In accordance with the approach of the composite toner image, the registration roller pair 23 of the sheet feeder 20 conveys the sheet Sp to a secondary transfer nip formed between the transfer belt 42 and the secondary transfer roller 47.

The secondary transfer nip is formed between a particular circumferential section on the outer circumferential surface of the transfer belt 42 wound around the driving roller 44B and the secondary transfer roller 47. As the power supply applies a secondary transfer bias to the secondary transfer roller 47, a secondary transfer electric field is produced at the secondary transfer nip formed between the secondary transfer roller 47 and the grounded driving roller 44B via the transfer belt 42.

The registration roller pair 23 feeds the sheet Sp to the secondary transfer nip at a velocity identical to that of the rotating transfer belt 42 at a time when the composite toner image formed on the transfer belt 42 reaches the secondary transfer nip. Accordingly, the yellow, cyan, magenta, and black toner images superimposed on the transfer belt 42 are secondarily transferred onto the sheet Sp successively conveyed to the transfer device 40.

After the secondary transfer, the belt cleaner 48 in contact with the transfer belt 42 scrapes residual toner particles failed to be transferred onto the sheet Sp and therefore remaining on the transfer belt 42 thereoff, removing the residual toner particles from the transfer belt 42.

The fixing device 50 fixes the composite toner image secondarily transferred from the transfer belt 42 onto the sheet Sp thereon under heat and pressure, thus forming a full-color toner image on the sheet Sp, for example. An output roller pair 61 ejects the sheet Sp bearing the fixed toner image onto an outside of the image forming apparatus 1, for example, an output tray. Thus, a series of image forming processes performed by the image forming apparatus 1 is completed.

A description is provided of a construction of the fixing device 50 according to a first example embodiment.

Figure 2:
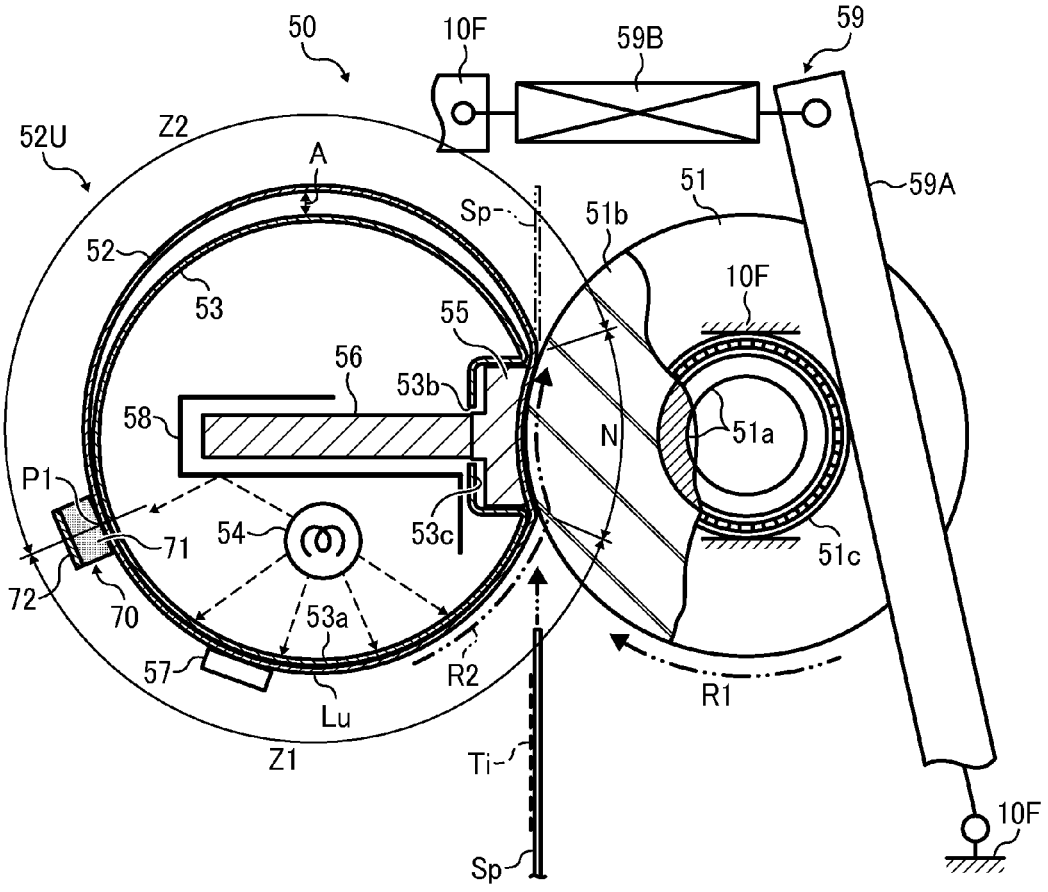
FIG. 2 is a schematic vertical sectional view of a fixing device according to a first example embodiment incorporated in the image forming apparatus shown in FIG. 1.

FIG. 2 is a vertical sectional view of the fixing device 50. As shown in FIG. 2, the fixing device 50 (e.g., a fuser or a fusing unit) includes a pressure roller 51 serving as a pressure rotator, a fixing belt 52 serving as a heating rotator or an endless belt, a thermal conductor 53, a heater 54 serving as a heater or a heat source, a nip formation pad 55, a reinforcement 56 serving as a support, a temperature sensor 57, a reflection plate 58, and a pressurization assembly 59 described below. The heater 54, the nip formation pad 55, the thermal conductor 53, and the reinforcement 56, together with a supportive stay, a seal, and the like, are situated inside a loop formed by the fixing belt 52 and disposed opposite an inner circumferential surface of the fixing belt 52. The fixing belt 52 and the components disposed inside the loop formed by the fixing belt 52, that is, the thermal conductor 53, the heater 54, the nip formation pad 55, the reinforcement 56, and the reflection plate 58, may constitute a belt unit 52U separably coupled with the pressure roller 51.

A detailed description is now given of a construction of the pressure roller 51.

The pressure roller 51, having a diameter in a range of from about 20 mm to about 40 mm, is a pressure rotator constructed of a hollow cored bar 51*a* and an elastic layer 51*b* coating the cored bar 51*a*. For example, the elastic layer 51*b* is made of silicone rubber foam, silicone rubber, fluoro rubber, or the like. Optionally, the pressure roller 51 may further include a thin release layer coating the elastic layer 51*b* and being made of tetrafluoroethylene-perfluoroalkylvinylether copolymer (PFA), polytetrafluoroethylene (PTFE), or the like.

The pressure roller 51 is pressed against the nip formation pad 55 via the fixing belt 52 at a portion of the pressure roller 51 disposed in proximity to the fixing belt 52, forming a fixing nip N between the pressure roller 51 and the fixing belt 52. The fixing nip N defines a region where the pressure roller 51 is pressed against a part of the fixing belt 52 that contacts the nip formation pad 55. While the sheet Sp is absent, the pressure roller 51 is pressed against the nip formation pad 55 via the fixing belt 52. Conversely, while the sheet Sp is conveyed through the fixing nip N, the pressure roller 51 is pressed against the nip formation pad 55 via the sheet Sp and the fixing belt 52.

A pair of bearings 51*c* is mounted on both lateral ends of the pressure roller 51 in an axial direction thereof, respectively. For example, the pair of bearings 51*c* is movable horizontally in FIG. 2 as it is guided by a frame 10F of the body 10 of the image forming apparatus 1 depicted in FIG. 1. The pair of bearings 51*c* is constantly biased against the nip formation pad 55 by the pressurization assembly 59 constructed of a lever 59A and a tension spring 59B, for example.

The pressure roller 51 mounts a driving gear at one lateral end of the pressure roller 51 in the axial direction thereof. The pressure roller 51 is driven and rotated clockwise in FIG. 2 in a rotation direction R1 through the driving gear. Optionally, a heater such as a halogen heater may be situated inside the pressure roller 51.

A detailed description is now given of a construction of the fixing belt 52.

The fixing belt 52 is a thin, flexible endless belt or film rotatable counterclockwise in FIG. 2 in a rotation direction R2.

The fixing belt 52 is constructed of a base layer constituting the inner circumferential surface that slides over the nip formation pad 55; an elastic layer coating the base layer; and a release layer coating the elastic layer, which are layered in this order from the inner circumferential surface to an outer circumferential surface of the fixing belt 52. Hence, the fixing belt 52 has a total thickness not greater than about 500 micrometers, for example.

The base layer, having a thickness in a range of from about 30 micrometers to about 100 micrometers, for example, is made of metal such as nickel and stainless steel or resin such as polyimide.

The elastic layer, having a thickness in a range of from about 100 micrometers to about 300 micrometers, for example, is made of rubber such as silicone rubber, silicone rubber foam, and fluoro rubber. The elastic layer absorbs slight surface asperities of the fixing belt 52 at the fixing nip N, facilitating even heat conduction from the fixing belt 52 to a toner image Ti on the sheet Sp and thereby suppressing formation of an orange peel image on the sheet Sp.

The release layer, having a thickness in a range of from about 5 micrometers to about 50 micrometers, for example, is made of PFA, PTFE, or the like. The release layer may be made of polyimide (PI), polyamide imide (PAT), polyether imide (PEI), polyether sulfide (PES), polyether ether ketone (PEEK), or the like, instead of PFA and PTFE.

The fixing belt 52 has a loop diameter in a range of from about 15 mm to about 120 mm. According to this example embodiment, the fixing belt 52 has a loop diameter of about 30 mm, for example.

A detailed description is now given of a configuration of the thermal conductor 53.

The thermal conductor 53 guides the fixing belt 52 such that the fixing belt 52 is rotatable in a circumferential direction thereof. The heater 54 heats the thermal conductor 53 which in turn heats the fixing belt 52.

For example, the power supply located inside the body 10 of the image forming apparatus 1 controls the heater 54 to heat the thermal conductor 53 with radiation heat or light. The reflection plate 58 reflects the radiation heat or light from the heater 54 to a part of the thermal conductor 53, that is, a rotation guide 53*a* spanning a particular circumferential span of the thermal conductor 53. A part of the fixing belt 52 that contacts the rotation guide 53*a* is heated by the rotation guide 53*a*.

The thermal conductor 53 is a metal thermal conductor made of conductive metal such as aluminum, iron, and stainless steel. The thermal conductor 53 having a thickness not greater than about 0.2 mm conducts heat from the heater 54 to the fixing belt 52 effectively.

The thermal conductor 53 is disposed in proximity to or in contact with the inner circumferential surface of the fixing belt 52 in a circumferential span on the fixing belt 52 other than the fixing nip N in the circumferential direction of the fixing belt 52. At the fixing nip N, the thermal conductor 53 includes a recess 53*c* formed into a substantial groove and having a slit 53*b* penetrating through an interior bottom wall of the recess 53*c*.

At an ambient temperature, a gap A between the fixing belt 52 and the thermal conductor 53 produced in the circumferential span on the fixing belt 52 other than the fixing nip N is greater than 0 mm and not greater than about 2 mm. The gap A suppresses abrasion of the thermal conductor 53 and the fixing belt 52 and degradation in heating efficiency through heat conduction from the thermal conductor 53 to the fixing belt 52.

Additionally, the substantially tubular thermal conductor 53 disposed in proximity to the fixing belt 52 retains a substantially circular trajectory in cross-section, that is, a posture, of the flexible fixing belt 52 rotating in the rotation direction R2, reducing deformation and resultant degradation and breakage of the fixing belt 52.

In order to decrease overall resistance between the thermal conductor 53 and the fixing belt 52 sliding thereover, a slide face, that is, an outer circumferential surface, of the thermal conductor 53 may be made of a material having a decreased friction coefficient or the inner circumferential surface of the fixing belt 52 may be coated with a surface layer made of a material containing fluorine.

If the fixing device 50 includes a separate component that conducts heat from the heater 54 to the fixing belt 52 evenly and stabilizes motion of the fixing belt 52 as it is driven, the fixing device 50 may employ a direct heating method in which the heater 54 heats the fixing belt 52 directly without the thermal conductor 53. In this case, the fixing device 50 reduces its total thermal capacity by a thermal capacity of the thermal conductor 53, heating the fixing belt 52 quickly and saving energy.

A detailed description is now given of a configuration of the heater 54.

The heater 54 serving as a heater or a heat source includes a halogen heater or a carbon heater. The reflection plate 58 reflects the radiation light from the heater 54 to a part of the thermal conductor 53, that is, the rotation guide 53*a* defining the particular circumferential span of the thermal conductor 53 in a circumferential direction thereof. Thus, the heater 54 heats the rotation guide 53*a* of the thermal conductor 53 effectively.

The rotation guide 53*a* defining the particular circumferential span of the thermal conductor 53 that contacts a part of the fixing belt 52 in the circumferential direction thereof heats the fixing belt 52 effectively by heat conduction. Thus, the fixing belt 52 is heated by the heater 54 indirectly through the thermal conductor 53. The heater 54 disposed inside the loop formed by the fixing belt 52 and the thermal conductor 53 heats the rotation guide 53*a* defining the particular circumferential span of the thermal conductor 53 that contacts a particular circumferential span Z1 on the fixing belt 52.

Output of the heater 54 is controlled based on the temperature of the outer circumferential surface of the fixing belt 52 detected by the temperature sensor 57. The temperature sensor 57 includes a thermistor disposed opposite the outer circumferential surface of the fixing belt 52. Thus, the fixing belt 52 is heated to a desired fixing temperature by the heater 54 controlled as described above.

A detailed description is now given of a configuration of the nip formation pad 55.

The nip formation pad 55 is mounted on and supported by the frame 10F of the body 10 of the image forming apparatus 1 such that the inner circumferential surface of the fixing belt 52 is slidable over the nip formation pad 55. The nip formation pad 55 presses against the pressure roller 51 via the fixing belt 52 to form the fixing nip N between the pressure roller 51 and the fixing belt 52, through which the sheet Sp is conveyed under heat and pressure from the fixing belt 52 and the pressure roller 51. The platy reinforcement 56 substantially orthogonal to the nip formation pad 55 abuts a back face of the nip formation pad 55, reinforcing the nip formation pad 55 against pressure from the pressure roller 51. Optionally, a lubricant such as fluorine grease and silicone oil may be applied between the fixing belt 52 and the thermal conductor 53 to reduce abrasion of the fixing belt 52 as the fixing belt 52 slides over the thermal conductor 53. If the thermal conductor 53 is made of or coated with a material or a slide assist sheet that facilitates sliding of the fixing belt 52, the lubricant may be unnecessary.

As described above, the fixing device 50 includes the endless fixing belt 52 serving as a heating rotator formed into the loop inside which the heater 54, the thermal conductor 53, the nip formation pad 55, the reinforcement 56, and the reflection plate 58 are situated. The pressure roller 51 disposed opposite the nip formation pad 55 via the fixing belt 52, together with the nip formation pad 55, forms the fixing nip N between the pressure roller 51 and the fixing belt 52 where the nip formation pad 55 presses a part of the fixing belt 52 in the circumferential direction thereof heated by the heater 54 against the sheet Sp. As the pressure roller 51 is driven and rotated to drive and rotate the fixing belt 52 by friction between the pressure roller 51 and the fixing belt 52, the thermal conductor 53 conducts heat from the heater 54 to the fixing belt 52 in an outboard circumferential span on the fixing belt 52 outboard from the fixing nip N in the circumferential direction of the fixing belt 52.

A description is provided of a configuration of a comparative fixing device.

The comparative fixing device includes a tubular thermal conductor interposed between a heater and a fixing belt to conduct heat radiated from the heater to the fixing belt while supporting the fixing belt such that the fixing belt is rotatable in a circumferential direction thereof, thus stabilizing the trajectory of the fixing belt and reducing uneven heating of the fixing belt. However, heat radiated from the heater is stored in the tubular metal thermal conductor and conducted to the fixing belt through the thermal conductor contacting the fixing belt. Accordingly, an interval produced between the thermal conductor and a part of the fixing belt in an axial direction thereof may prohibit heat conduction from the thermal conductor to the fixing belt, varying a fixing temperature of the fixing belt in the axial direction thereof. The varied fixing temperature may degrade the quality of a toner image fixed on a sheet.

To address this circumstance, a tension roller may be disposed outboard from a heated span on the fixing belt where the fixing belt is contacted and heated by the thermal conductor. The tension roller applies tension to an inner circumferential surface of the fixing belt to adhere the fixing belt to the thermal conductor, facilitating even heat conduction in the axial direction of the fixing belt.

Alternatively, three or more restrictors may contact an outer circumferential surface of the fixing belt to restrict the trajectory of the fixing belt, preventing the trajectory of the fixing belt from shifting outward.

However, the tension roller, although it adheres the fixing belt to the thermal conductor, may increase a driving torque of the fixing belt, causing slippage of the fixing belt when the fixing belt does not rotate in accordance with rotation of a pressure roller.

For example, if the tension roller applies tension great enough to adhere the fixing belt to the thermal conductor, the fixing belt may adhere to the thermal conductor unnecessarily in a downstream circumferential span on the fixing belt disposed downstream form a fixing nip formed between the fixing belt and the pressure roller where the heater does not heat the fixing belt. Accordingly, the fixing belt may be placed with an increased load as it slides over the thermal conductor in the downstream circumferential span where the heater does not heat the fixing belt. Consequently, a driving torque to drive and rotate the fixing belt may increase substantially, causing slippage of the fixing belt as the fixing belt is driven and rotated by the pressure roller frictionally via the sheet during a fixing operation.

Conversely, the three or more restrictors contacting the outer circumferential surface of the fixing belt restrict the trajectory of the fixing belt only when the trajectory of the fixing belt shifts outward. That is, the three or more restrictors do not apply tension to the fixing belt. Accordingly, if the trajectory of the fixing belt shifts inward, the fixing belt may suffer from uneven heat conduction from the thermal conductor.

A description is provided of a construction of an abutment 70 incorporated in the fixing device 50.

As shown in FIG. 2, the abutment 70 is disposed upstream from the fixing nip N in the rotation direction R2 of the fixing belt 52 and abuts the outer circumferential surface of the fixing belt 52.

The abutment 70 contacts the fixing belt 52 with given pressure at a particular position P1 disposed upstream from the nip formation pad 55 in the rotation direction R2 of the fixing belt 52. While the fixing device 50 is actuated and the pressure roller 51 is rotated in the rotation direction R1, the abutment 70 frictionally contacts the fixing belt 52 rotating in the rotation direction R2 while contacting the thermal conductor 53 such that the abutment 70 presses the fixing belt 52 against the thermal conductor 53 at the particular position P1, thus exerting a given resistance to the fixing belt 52 rotating in the rotation direction R2.

Accordingly, as the pressure roller 51 rotates, tension of the fixing belt 52 in the particular circumferential span Z1 spanning from the particular position P1 to the fixing nip N is greater than tension of the fixing belt 52 in an outboard circumferential span Z2 on the fixing belt 52 that is disposed outboard from the particular circumferential span Z1 and downstream from the fixing nip N in the rotation direction R2 of the fixing belt 52.

The abutment 70 restricts the trajectory of the fixing belt 52 to a restricted trajectory within the particular circumferential span Z1 where the thermal conductor 53 contacts and heats the fixing belt 52, that is, a given posture of the fixing belt 52 rotating in the particular circumferential span Z1. While the pressure roller 51 rotates in the rotation direction R1, the abutment 70 serves as a restrictor that restricts the posture of the fixing belt 52 rotating in the particular circumferential span Z1 to the restricted trajectory corresponding to a substantially circular cross-section along the outer circumferential surface of the thermal conductor 53, together with the pressure roller 51.

The fixing belt 52 is isolated from the thermal conductor 53 in at least a part of the outboard circumferential span Z2 outboard from the particular circumferential span Z1 and downstream from the fixing nip N in the rotation direction R2 of the fixing belt 52, for example, in the substantially entire outboard circumferential span Z2.

The abutment 70 exerts a load to the fixing belt 52 such that pressure exerted from the abutment 70 to the particular circumferential span Z1 on the fixing belt 52 and the rotation guide 53*a* defining the particular circumferential span of the thermal conductor 53 is in an appropriate range appropriate to conduct heat from the thermal conductor 53 to the fixing belt 52 contacted by the thermal conductor 53. For example, the abutment 70 exerts a load to the fixing belt 52 such that the fixing belt 52 attains tension to press against the thermal conductor 53 with appropriate pressure appropriate to conduct heat from the thermal conductor 53 to the fixing belt 52. For example, the appropriate pressure is not smaller than about 2 N. The abutment 70 is resistant against temperatures not lower than about 200 degrees centigrade, for example.

The abutment 70 is constructed of an abutment portion 71 and a support portion 72. The abutment portion 71 includes a front face contacting the fixing belt 52. The support portion 72 supports the abutment portion 71 at a given position. The support portion 72 adjoins the abutment portion 71 on at least one of both lateral ends of the abutment portion 71 in a longitudinal direction thereof and a back face of the abutment portion 71, thus supporting the abutment portion 71 at the given position relative to the frame 10F of the body 10 of the image forming apparatus 1 or a stay or the like mounted on the frame 10F.

Figure 3:
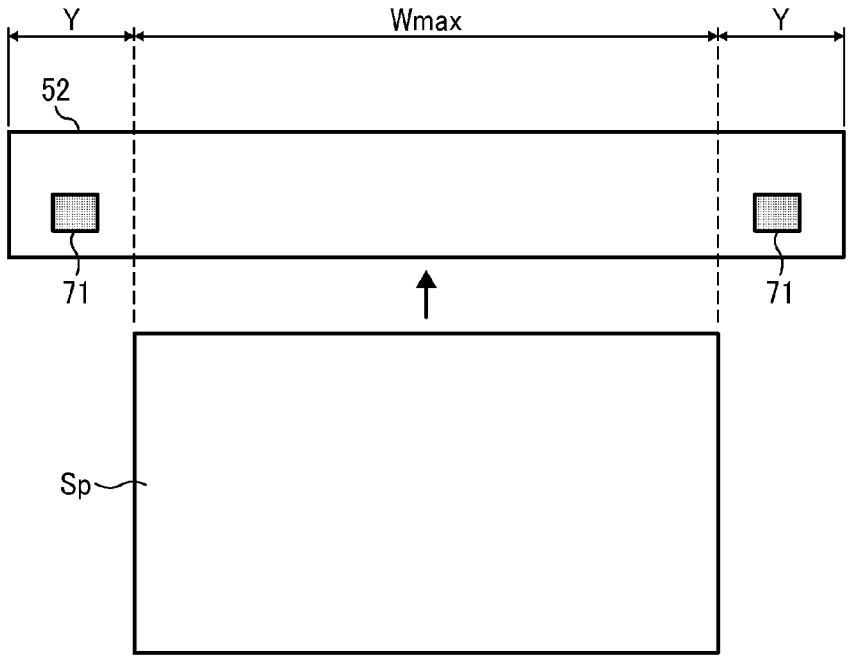
FIG. 3 is a plan view of a fixing belt and an abutment portion incorporated in the fixing device shown in FIG. 2.
Figure 4:
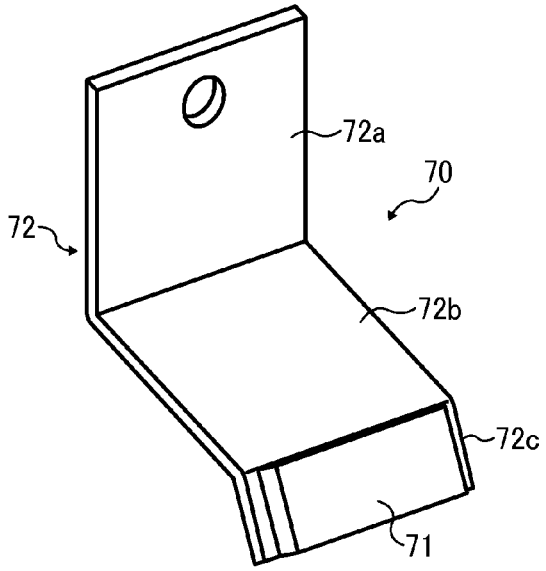
FIG. 4 is a perspective view of an abutment incorporated in the fixing device shown in FIG. 2.

FIG. 3 is a plan view of the fixing belt 52 and the abutment portion 71. FIG. 4 is a perspective view of the abutment 70.

A detailed description is now given of a configuration of the abutment portion 71.

As shown in FIG. 4, the abutment portion 71 is supported by the cantilever, platy support portion 72 at the back face of the abutment portion 71 in a longitudinal direction of the abutment 70.

The abutment portion 71, since it contacts the fixing belt 52, is made of a material having a decreased rigidity small enough to be immune from damaging the fixing belt 52 and a decreased friction small enough to suppress abrasion of the fixing belt 52.

For example, the abutment portion 71 is made of felt or resin such as PFA and PTFE. The abutment portion 71, since it contacts the heated fixing belt 52, is resistant against temperatures not lower than about 200 degrees centigrade, for example.

A detailed description is now given of a configuration of the support portion 72.

As shown in FIG. 4, the support portion 72 is constructed of a mount plate 72*a* mounted on the frame 10F or the like of the body 10 of the image forming apparatus 1; a resilient plate 72*b* having resilience and adjoining the mount plate 72*a*; and an attachment face 72*c* adjoining the resilient plate 72*b* and being attached with the abutment portion 71. The support portion 72 is made of metal such as iron and stainless steel.

The mount plate 72*a* is fastened to and mounted on the frame 10F or the like with a screw. The abutment portion 71 is attached to or adhered to the attachment face 72*c* of the support portion 72 with an adhesive, thus being mounted on the support portion 72.

As shown in FIG. 3, the abutment portion 71 is disposed opposite an outboard axial span Y at each lateral end of the fixing belt 52 in an axial direction thereof that is outboard from a fixing span, that is, a maximum conveyance span Wmax in the axial direction of the fixing belt 52. The maximum conveyance span Wmax defines the fixing span on the fixing belt 52 where a sheet Sp of an increased size (e.g., a maximum size) is conveyed through the fixing nip N for a fixing operation. Each abutment portion 71 contacts the fixing belt 52 in the outboard axial span Y outboard from the maximum conveyance span Wmax in the axial direction of the fixing belt 52.

As shown in FIG. 3, the two abutments 70 are disposed opposite both lateral ends of the fixing belt 52 in the axial direction thereof, respectively. Alternatively, three or more abutments 70 may be disposed opposite the fixing belt 52 at multiple different positions spaced apart from each other in the axial direction of the fixing belt 52.

As shown in FIGS. 2 and 3, as the pressure roller 51 rotates, the abutment 70 disposed at the given position inside the fixing device 50 increases tension of the fixing belt 52 in the particular circumferential span Z1 relative to tension of the fixing belt 52 in an outboard circumferential span on the fixing belt 52 that is disposed outboard from the particular circumferential span Z1 in the circumferential direction of the fixing belt 52. The abutment 70 restricts the trajectory of the fixing belt 52 to a restricted trajectory Lu that is substantially circular in cross-section within the particular circumferential span Z1 where the thermal conductor 53 contacts and heats the fixing belt 52. Conversely, the abutment 70 separates the fixing belt 52 from the thermal conductor 53 in a part of the outboard circumferential span outboard from the particular circumferential span Z1, that is, the outboard circumferential span Z2 downstream from the fixing nip N in the rotation direction R2 of the fixing belt 52.

At least one of the abutment portion 71 and the support portion 72 is electrically insulated. If both the abutment portion 71 and the support portion 72 are conductive, the electric charge of the toner image Ti on the sheet Sp inside the image forming device 30 and the transfer electric current of the primary transferor 41 may escape to the earth through the fixing belt 52, the abutment 70, and the frame 10F, resulting in formation of a faulty toner image such as a scattered image and a spotted image.

As described above with reference to FIG. 1, the image forming apparatus 1 for forming the toner image Ti on the sheet Sp includes the image forming device 30 that forms the toner image Ti, the transfer device 40 that transfers the toner image Ti onto the sheet Sp, and the fixing device 50 that fixes the toner image Ti on the sheet Sp under heat and pressure. As the sheet Sp bearing the toner image Ti developed with the developer is conveyed through the fixing device 50, the fixing device 50 fixes the toner image Ti on the sheet Sp. Thereafter, the output roller pair 61 ejects the sheet Sp onto the outside of the image forming apparatus 1.

A description is provided of a series of fixing processes performed by the fixing device 50.

Figure 5A:
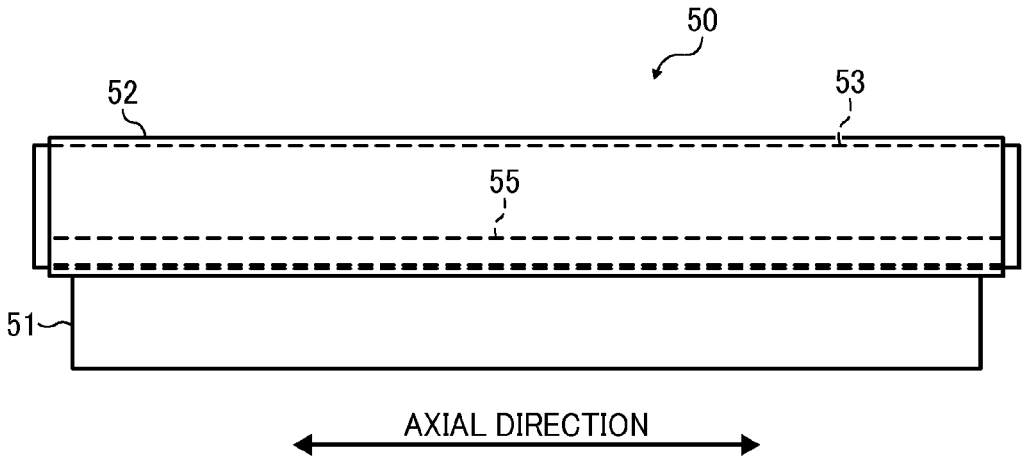
FIG. 5A is a plan view of the fixing device shown in FIG. 2 illustrating a thermal conductor incorporated therein at an ambient temperature.

FIG. 5A is a plan view of the fixing device 50 illustrating the thermal conductor 53 at an ambient temperature. As shown in FIG. 5A, when the fixing device 50 is at the ambient temperature, the fixing belt 52 adheres to the thermal conductor 53 substantially evenly in the particular circumferential span Z1 throughout the entire axial span of the fixing belt 52 in the axial direction thereof. Conversely, the fixing belt 52 is disposed in proximity to the thermal conductor 53 substantially evenly in the outboard circumferential span Z2.

As shown in FIGS. 1 and 2, as the image forming apparatus 1 receives a print job and the fixing device 50 turns on the heater 54, the heater 54 heats the thermal conductor 53. The heated thermal conductor 53 in contact with the fixing belt 52 in turn heats the fixing belt 52.

As the sheet Sp transferred with the toner image Ti formed by the image forming device 30 is conveyed through the fixing device 50, the fixing device 50 fixes the toner image Ti on the sheet Sp under heat and pressure.

For example, as the image forming apparatus 1 is powered on, the power supply supplies power to the heater 54 and the pressure roller 51 starts rotating in the rotation direction R1. The fixing belt 52 is driven and rotated in the rotation direction R2 by friction between the pressure roller 51 and the fixing belt 52.

A sheet Sp separated from other sheets Sp loaded on the sheet feeder 20 is conveyed to the secondary transferor 46. The secondary transferor 46 secondarily transfers the unfixed toner image Ti produced by the toner images in the four colors, that is, the yellow, cyan, magenta, and black toner images, onto the sheet Sp.

Thereafter, the sheet Sp bearing the unfixed toner image Ti is conveyed to the fixing nip N formed between the fixing belt 52 and the pressure roller 51 of the fixing device 50.

As the sheet Sp bearing the toner image Ti is conveyed through the fixing nip N, the sheet Sp is applied with heat and pressure, that is, heat from the fixing belt 52, pressure from the pressure roller 51, and a reaction force from the nip formation pad 55. Thus, the toner image Ti is fixed on the sheet Sp.

The fixing device 50 that repeats a series of fixing processes described above includes the fixing belt 52 contacted by the thermal conductor 53 to conduct heat to the fixing belt 52 evenly and effectively in the particular circumferential span Z1 immediately upstream from the fixing nip N in the rotation direction R2 of the fixing belt 52. Thus, the fixing belt 52 is heated to the proper fixing temperature. Additionally, in the outboard circumferential span Z2 outboard from the particular circumferential span Z1 in the circumferential direction of the fixing belt 52, the fixing belt 52 is immune from being wound around or caught on the thermal conductor 53, suppressing load imposed on the rotating fixing belt 52 by friction between the fixing belt 52 and the thermal conductor 53. Accordingly, the thermal conductor 53 conducts heat to the fixing belt 52 evenly and sufficiently without increasing a driving torque of the pressure roller 51.

The length of the particular circumferential span Z1 on the fixing belt 52 that is appropriate to conduct heat from the thermal conductor 53 to the fixing belt 52 contacting the thermal conductor 53 and to drive and rotate the fixing belt 52 is changed readily according to the location of the abutment 70. Additionally, tension of the fixing belt 52 in the particular circumferential span Z1 is changed according to the strength of the resistance imposed from the abutment 70 onto the fixing belt 52, changing a bias exerted from the fixing belt 52 to the thermal conductor 53 in a direction in which the fixing belt 52 is looped over the thermal conductor 53. Accordingly, the thermal conductor 53 in contact with the fixing belt 52 conducts heat to the fixing belt 52 effectively.

Since heat radiated from the heater 54 is concentrated onto the rotation guide 53*a* defining the particular circumferential span Z1 of the thermal conductor 53, the rotation guide 53*a* heats the fixing belt 52 effectively by heat conduction.

Figure 5B:
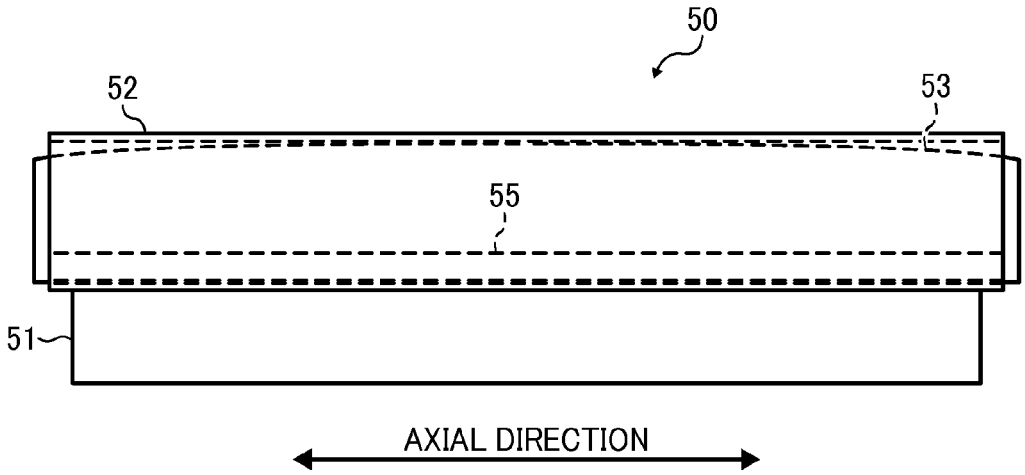
FIG. 5B is a plan view of the fixing device shown in FIG. 2 illustrating the thermal conductor at an increased temperature.

After the fixing device 50 repeats fixing jobs, the thermal conductor 53 heated by the heater 54 may overheat and suffer from thermal expansion and deformation. For example, an amount of thermal expansion, that is, a dimension, of a center of the thermal conductor 53 in a longitudinal direction thereof is greater than that of each lateral end of the thermal conductor 53 in the longitudinal direction thereof. FIG. 5B is a plan view of the fixing device 50 illustrating the thermal conductor 53 at an increased temperature. As shown in FIG. 5B, the center of the thermal conductor 53 in the longitudinal direction thereof bulges outward. Conversely, an amount of thermal expansion of each lateral end of the thermal conductor 53 in the longitudinal direction thereof is relatively small.

The expanded thermal conductor 53 presses against a center of the fixing belt 52 in the axial direction thereof, shifting the trajectory of the fixing belt 52 outward. Accordingly, an interval is produced between the thermal conductor 53 and the fixing belt 52 at each lateral end of the fixing belt 52 in the axial direction thereof. Consequently, the thermal conductor 53 may heat each lateral end of the fixing belt 52 in the axial direction thereof with a degraded efficiency.

As shown in FIG. 2, the thermal conductor 53 and the abutment 70 sandwich the fixing belt 52 at an upstream portion of the rotation guide 53*a* heated by the heater 54 in the rotation direction R2 of the fixing belt 52.

Accordingly, while the pressure roller 51 rotates, the fixing belt 52 is stretched from the particular position P1 in a direction in which the fixing belt 52 is wound around the thermal conductor 53 in a heated span of the fixing belt 52 defined between the particular position P1 where the abutment 70 restricts the trajectory of the fixing belt 52 and the fixing nip N in the rotation direction R2 of the fixing belt 52. Tension exerted to the fixing belt 52 eliminates the interval between the fixing belt 52 and the thermal conductor 53, allowing the thermal conductor 53 to conduct heat from the heater 54 to the heated span of the fixing belt 52 effectively.

The abutment 70 disposed opposite each lateral end of the fixing belt 52 and the thermal conductor 53 in the axial direction of the fixing belt 52 restricts the trajectory of the fixing belt 52 to the restricted trajectory Lu within the particular circumferential span Z1 at each lateral end of the fixing belt 52 in the axial direction thereof precisely. Hence, the fixing belt 52 adheres to the thermal conductor 53 substantially evenly throughout the entire axial span of the fixing belt 52 within the particular circumferential span Z1.

The fixing belt 52 slides over the abutment 70 while the abutment 70 restricts motion of the fixing belt 52 by exerting a load not smaller than about 2 N or 200 g. Accordingly, the outer circumferential surface of the fixing belt 52 may suffer from degradation such as surface roughness. To address this circumstance, the abutment 70 is disposed outboard from the maximum conveyance span Wmax depicted in FIG. 3 on the fixing belt 52 in the axial direction thereof, preventing adverse effect on the toner image Ti on the sheet Sp due to degradation in the condition of the outer circumferential surface of the fixing belt 52.

Additionally, the abutment 70 imposes a resistance to the fixing belt 52 rotating in the rotation direction R2 at the particular position P1 upstream from the fixing nip N in the rotation direction R2 of the fixing belt 52, increasing tension of the fixing belt 52 that adheres the fixing belt 52 to the thermal conductor 53 in the particular circumferential span Z1. Conversely, the abutment 70 produces the interval between the fixing belt 52 and the thermal conductor 53 in the outboard circumferential span Z2 outboard from the particular circumferential span Z1 in the rotation direction R2 of the fixing belt 52.

Accordingly, the abutment 70 reduces friction between the thermal conductor 53 and the fixing belt 52 sliding over the thermal conductor 53, eliminating a restrictor disposed opposite the fixing belt 52 in the outboard circumferential span Z2 downstream from the fixing nip N in the rotation direction R2 of the fixing belt 52 to restrict the trajectory of the fixing belt 52 and preventing thermal expansion of the fixing belt 52. Consequently, the abutment 70 reduces the thermal capacity of the fixing device 50 and downsizes the fixing device 50, thus shortening a warm-up time taken to warm up the fixing device 50.

The abutment 70, disposed outboard from the fixing span (e.g., the maximum conveyance span Wmax depicted in FIG. 3) on the fixing belt 52 in the axial direction thereof where the fixing belt 52 heats the sheet Sp, contacts the fixing belt 52 with desired pressure. Accordingly, the fixing belt 52 rotating in the rotation direction R2 contacts the thermal conductor 53 which conducts heat to the fixing belt 52 throughout the entire fixing span on the fixing belt 52 in the axial direction thereof precisely. Further, the abutment 70 is immune from earlier degradation due to overheating as the abutment 70 contacts the fixing belt 52 heated to an increased temperature.

The abutment portion 71 of the abutment 70 that contacts the fixing belt 52 frictionally is made of a flexible material having a decreased rigidity that does not damage the fixing belt 52 and being resistant against heat and abrasion. The support portion 72 of the abutment 70 elastically supports the abutment portion 71 such that the abutment portion 71 presses the fixing belt 52 against the thermal conductor 53 with given pressure at the particular position P1. The support portion 72 has a mechanical strength and a rigidity great enough to support the abutment portion 71.

At least one of the abutment portion 71 and the support portion 72 is insulative, preventing the transfer electric current of the primary transferor 41 inside the body 10 of the image forming apparatus 1 from being grounded through the fixing belt 52 and the abutment 70 and therefore preventing the image forming apparatus 1 from forming a faulty toner image on the sheet Sp.

Accordingly, the thermal conductor 53 of the fixing device 50 conducts heat to the fixing belt 52 evenly and sufficiently to fix the toner image Ti on the sheet Sp properly without increasing a load imposed on the fixing belt 52 rotating in the rotation direction R2 and a driving torque of the pressure roller 51. The image forming apparatus 1 incorporating the fixing device 50 that fixes the toner image Ti on the sheet Sp with an even toner density forms the high quality toner image Ti on the sheet Sp.

Figure 6:
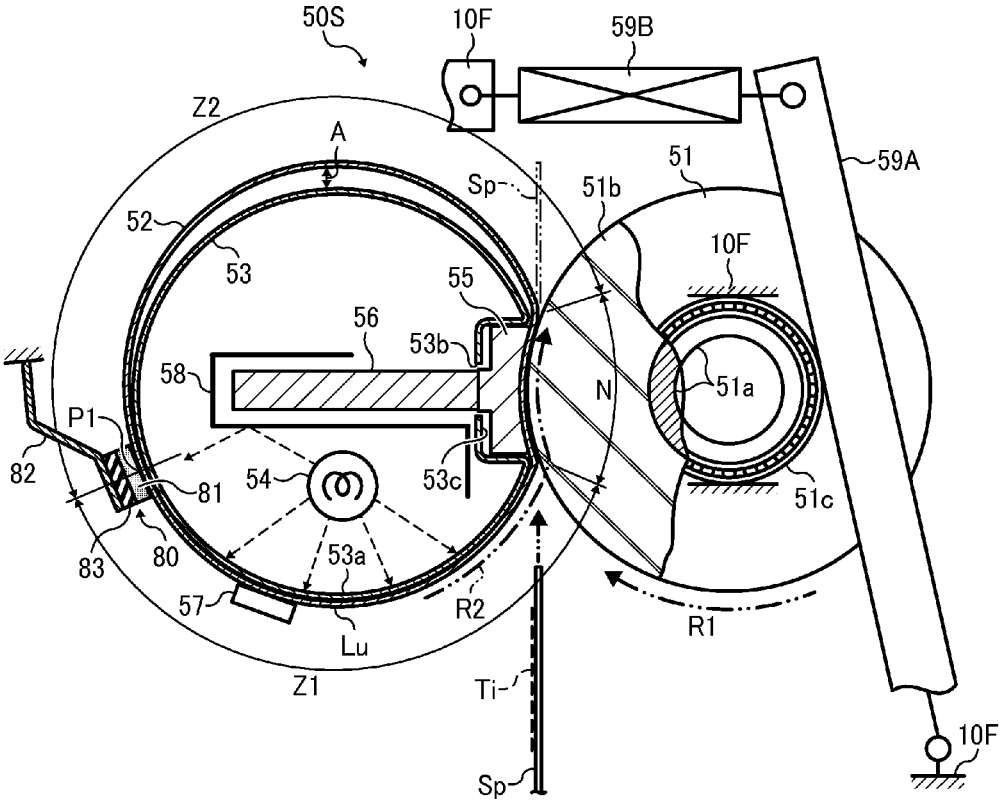
FIG. 6 is a vertical sectional view of a fixing device according to a second example embodiment of the present disclosure.
Figure 7:
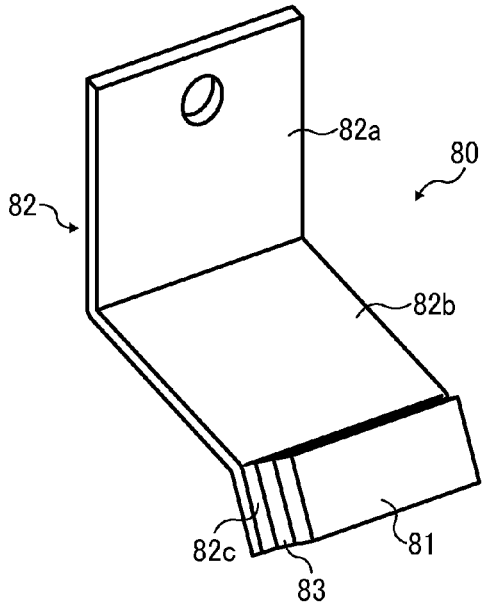
FIG. 7 is a perspective view of an abutment incorporated in the fixing device shown in FIG. 6.

With reference to FIGS. 6 and 7, a description is provided of a construction of a fixing device 50S according to a second example embodiment.

FIG. 6 is a vertical sectional view of the fixing device 50S. FIG. 7 is a perspective view of an abutment 80 incorporated in the fixing device 50S.

A plurality of example embodiments described below is applied to fixing devices being installable in the image forming apparatus 1 depicted in FIG. 1 and having a construction equivalent to the construction of the fixing device 50 depicted in FIG. 2 except for an abutment. Hence, the components installed in the fixing device 50S are assigned with the identical reference numerals and the following describes differences from the construction of the fixing device 50.

As shown in FIGS. 6 and 7, the abutment 80 serving as a restrictor that restricts the trajectory of the fixing belt 52 is constructed of an abutment portion 81, a support portion 82, and an elastic plate 83.

The abutment portion 81 contacts the fixing belt 52 frictionally. Like the abutment portion 71 of the abutment 70 depicted in FIG. 2, the abutment portion 81 is made of felt, PFA. PTFE, or the like. The abutment portion 81 is attached and adhered to the elastic plate 83.

Substantially like the support portion 72 of the abutment 70 depicted in FIG. 2, the support portion 82 is a bent plate disposed opposite a back face of the abutment portion 81 to support the abutment portion 81, positioning the abutment portion 81 at a substantially constant position relative to the thermal conductor 53. As shown in FIG. 7, the support portion 82 is constructed of a mount plate 82*a* fastened to the frame 10F or the like of the body 10 of the image forming apparatus 1 with a screw; a resilient plate 82*b* having resilience; and an attachment face 82*c* attached or adhered with the abutment portion 81 through the elastic plate 83.

The elastic plate 83 includes an elastic layer made of rubber or soft resin, for example. The elastic plate 83 is attached or adhered to the attachment face 82*c* of the support portion 82, thus being mounted on the support portion 82.

Accordingly, like the thermal conductor 53 of the fixing device 50, the thermal conductor 53 of the fixing device 50S conducts heat to the fixing belt 52 evenly and sufficiently to fix the toner image Ti on the sheet Sp properly without increasing a load imposed on the fixing belt 52 rotating in the rotation direction R2 and a driving torque of the pressure roller 51. The image forming apparatus 1 incorporating the fixing device 50S that fixes the toner image Ti on the sheet Sp with an even toner density forms the high quality toner image Ti on the sheet Sp.

Figure 8:
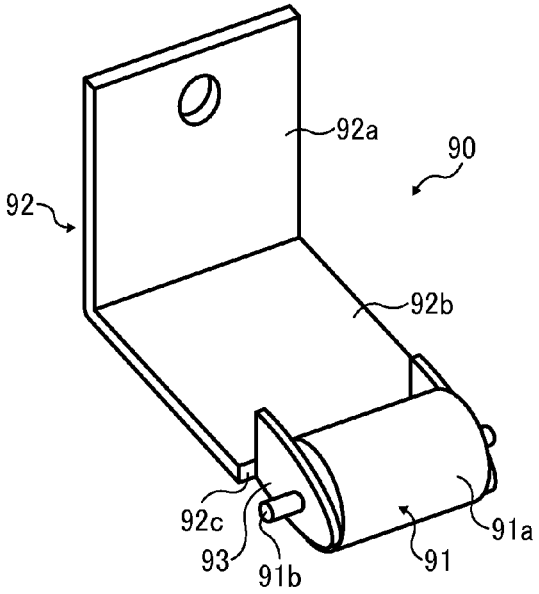
FIG. 8 is a perspective view of an abutment incorporated in a fixing device according to a third example embodiment of the present disclosure.

With reference to FIG. 8, a description is provided of a construction of a fixing device according to a third example embodiment.

FIG. 8 is a perspective view of an abutment 90 incorporated in the fixing device according to the third example embodiment. The fixing device according to the third example embodiment is equivalent to the fixing devices 50 and 50S depicted in FIGS. 2 and 6 except for the abutment 90.

As shown in FIG. 8, the abutment 90 serving as a restrictor that restricts the trajectory of the fixing belt 52 is constructed of a friction roller 91 serving as an abutment portion, a support portion 92, and a roller support bracket 93 interposed between the friction roller 91 and the support portion 92.

The friction roller 91 contacts the fixing belt 52 with given pressure and is rotatable in accordance with rotation of the fixing belt 52. The friction roller 91 presses the fixing belt 52 against the thermal conductor 53 at the particular position P1. The friction roller 91 includes an outer circumferential face 91*a* and a rigid support shaft 91*b*. Like the abutment portion 71 of the abutment 70 depicted in FIG. 4, the outer circumferential face 91*a* is made of felt, PFA, PTFE, or the like, for example. The support shaft 91*b* serves as a rotation axis of the outer circumferential face 91*a*.

The support portion 92 is a plate that rotatably supports the friction roller 91 at a substantially constant position relative to the thermal conductor 53. The support portion 92 is constructed of a mount plate 92*a* fastened to the frame 10F or the like of the body 10 of the image forming apparatus 1 with a screw; a resilient plate 92*b* having resilience; and a tip 92*c* that supports the friction roller 91 through the roller support bracket 93 mounted on the tip 92*c*.

The roller support bracket 93, while rotatably supporting the friction roller 91, retains the rotation axis of the friction roller 91 relative to the tip 92*c* of the support portion 92.

The friction roller 91 of the abutment 90 presses the fixing belt 52 against the thermal conductor 53 at the particular position P1, increasing a frictional resistance between the fixing belt 52 and the thermal conductor 53. Accordingly, the abutment 90 increases tension of the fixing belt 52 in the particular circumferential span Z1 relative to tension of the fixing belt 52 in the outboard circumferential span Z2 outboard from the particular circumferential span Z1 in the rotation direction R2 of the fixing belt 52.

Accordingly, like the thermal conductor 53 of the fixing device 50, the thermal conductor 53 of the fixing device according to the third example embodiment conducts heat to the fixing belt 52 evenly and sufficiently to fix the toner image Ti on the sheet Sp properly without increasing a load imposed on the fixing belt 52 rotating in the rotation direction R2 and a driving torque of the pressure roller 51. The image forming apparatus 1 incorporating the fixing device according to the third example embodiment that fixes the toner image Ti on the sheet Sp with an even toner density forms the high quality toner image Ti on the sheet Sp.

The support portion 92 biases the friction roller 91 serving as the abutment portion against the thermal conductor 53. Additionally, the friction roller 91 slides over the fixing belt 52 frictionally, reducing friction between the abutment 90 and the fixing belt 52 and slippage of the fixing belt 52. Accordingly, the abutment 90 does not damage the outer circumferential surface of the fixing belt 52 that comes into contact with the sheet Sp and decreases abrasion of the outer circumferential surface of the fixing belt 52. The support portion 92 has a mechanical strength and a rigidity great enough to support the friction roller 91 at an appropriate position.

The abutment (e.g., the abutments 70, 80, and 90) disposed outside the loop formed by the fixing belt 52 presses against the fixing belt 52. Alternatively, the abutment may be disposed inside the loop formed by the fixing belt 52 and the outer circumferential surface of the thermal conductor 53 may mount a projection or the like. Yet alternatively, the abutment may be disposed inside and outside the loop formed by the fixing belt 52. The fixing belt 52 contacts the thermal conductor 53 in a decreased contact span to produce the rotation guide 53*a* of the thermal conductor 53 that defines the particular circumferential span Z1 great enough for the fixing belt 52 to attain a desired temperature at the fixing nip N. Conversely, the fixing belt 52 is isolated from the thermal conductor 53 in the outboard circumferential span Z2 outboard from the particular circumferential span Z1 and the fixing nip N. Yet alternatively, heat radiated from the heater 54 may directly irradiate the fixing belt 52 not being looped over the thermal conductor 53 and therefore moving freely. The thermal conductor 53 disposed upstream from the fixing nip N in the rotation direction R2 of the fixing belt 52 may be shortened to have a circumferential length equivalent to the rotation guide 53*a* defining the particular circumferential span Z1.

If the abutment is disposed inside the loop formed by the fixing belt 52 and the outer circumferential surface of the thermal conductor 53 mounts the projection, the abutment may include one or more rollers that impose a decreased load to the fixing belt 52 rotating in the rotation direction R2. Yet alternatively, the abutment may be disposed opposite a plurality of positions on the fixing belt 52 in the axial direction thereof varying according to a contact width in the axial direction of the fixing belt 52 in which the abutment situated inside or outside the loop formed by the fixing belt 52 or situated inside and outside the loop formed by the fixing belt 52 contacts the fixing belt 52 and a support condition of the abutment.

The support portion (e.g., the support portions 72, 82, and 92) of the abutment (e.g., the abutments 70, 80, and 90) is fastened to and mounted on the frame 10F of the body 10 of the image forming apparatus 1. The support portion includes the resilient plate (e.g., the resilient plates 72*b*, 82*b*, and 92*b*) constituting a middle part of the support portion. Alternatively, the support portion may be a pivotable lever that supports the abutment portion (e.g., the abutment portions 71 and 81 and the friction roller 91) that contacts the fixing belt 52 frictionally such that the abutment portion moves closer to and away from the fixing belt 52 and the thermal conductor 53. A separate spring may bias the support portion against the fixing belt 52.

As shown in FIG. 8, the abutment 90 includes the friction roller 91 that contacts the fixing belt 52 frictionally and is rotatable in accordance with rotation of the fixing belt 52. Alternatively, the support portion 92 or the roller support bracket 93 may exert a given resistance to the friction roller 91.

As described above, the fixing device (e.g., the fixing devices 50 and 50S) includes the thermal conductor 53 that conducts heat to the fixing belt 52 evenly and sufficiently to fix the toner image Ti on the sheet Sp properly without increasing a load imposed on the fixing belt 52 rotating in the rotation direction R2 and a driving torque of the pressure roller 51. The image forming apparatus 1 incorporating the fixing device forms the high quality toner image Ti on the sheet Sp. The example embodiments described above are applied to fixing devices and image forming apparatuses, for example, to fixing devices incorporating an endless belt serving as a heating rotator and image forming apparatuses incorporating the fixing devices.

A description is provided of advantages of the fixing devices 50 and 50S.

As shown in FIGS. 2 and 6, a fixing device (e.g., the fixing devices 50 and 50S) includes an endless belt type heating rotator or an endless belt (e.g., the fixing belt 52) formed into a loop and rotatable in the rotation direction R2; a heater (e.g., the heater 54) disposed opposite the heating rotator to heat the heating rotator; and a thermal conductor (e.g., the thermal conductor 53) heated by the heater. The thermal conductor contacts the heating rotator to guide the heating rotator rotating in the rotation direction R2 and conduct heat from the heater to the heating rotator. A nip formation pad (e.g., the nip formation pad 55) is disposed inside the loop formed by the heating rotator. A pressure rotator (e.g., the pressure roller 51) is disposed opposite the nip formation pad via the heating rotator and pressed against the nip formation pad via the heating rotator to form the fixing nip N between the pressure rotator and a part of the heating rotator in the rotation direction R2 thereof, through which a recording medium (e.g., the sheet Sp) is conveyed. The pressure rotator drives and rotates the heating rotator frictionally. The thermal conductor conducts heat from the heater to the heating rotator in an outboard circumferential span thereon that is outboard from the fixing nip N in the rotation direction R2 of the heating rotator. An abutment (e.g., the abutments 70, 80, and 90) contacts and restricts the trajectory of the heating rotator to bring the heating rotator into contact with the thermal conductor in the particular circumferential span Z1 spanning from the particular position P1 upstream from the fixing nip N to the fixing nip N in the rotation direction R2 of the heating rotator and to separate the heating rotator from the thermal conductor in at least a part of the outboard circumferential span on the heating rotator.

Accordingly, the thermal conductor conducts heat to the heating rotator evenly and effectively in the particular circumferential span Z1 immediately upstream from the fixing nip N in the rotation direction R2 of the heating rotator. Thus, the heating rotator is heated to the desired fixing temperature. Additionally, in the outboard circumferential span Z2 outboard from the particular circumferential span Z1 in the rotation direction R2 of the heating rotator, the heating rotator is immune from being wound around or caught on the thermal conductor, suppressing load imposed on the heating rotator by friction between the heating rotator and the thermal conductor. Accordingly, the thermal conductor conducts heat to the heating rotator evenly and sufficiently to fix the toner image Ti on the sheet Sp without increasing the driving torque of the pressure rotator.

The abutment contacts the heating rotator at the particular position P1 to exert a resistance to rotation of the heating rotator. As the heating rotator rotates in the rotation direction R2, the abutment increases a tension of the heating rotator in the particular circumferential span Z1 from the particular position P1 to the fixing nip N relative to a tension of the heating rotator in the outboard circumferential span Z2.

Accordingly, the length of the particular circumferential span Z1 on the heating rotator that is appropriate to conduct heat from the thermal conductor to the heating rotator contacting the thermal conductor and to drive and rotate the heating rotator is changed readily according to the location of the abutment. Additionally, the tension of the heating rotator in the particular circumferential span Z1 is changed according to the strength of the resistance imposed from the abutment onto the heating rotator, changing a bias exerted from the heating rotator to the thermal conductor in a direction in which the heating rotator is looped over the thermal conductor. Accordingly, the thermal conductor in contact with the heating rotator conducts heat to the heating rotator effectively.

The heater disposed inside the loop formed by the heating rotator and the thermal conductor heats a rotation guide (e.g., the rotation guide 53*a*) defining the particular circumferential span Z1 of the thermal conductor that contacts the particular circumferential span Z1 on the heating rotator.

Since heat radiated from the heater is concentrated onto the rotation guide defining the particular circumferential span Z1 of the thermal conductor, the rotation guide heats the heating rotator effectively by heat conduction.

As shown in FIG. 3, the abutment contacts the heating rotator in the outboard axial span Y on the heating rotator in an axial direction thereof that is outboard from the fixing span (e.g., the maximum conveyance span Wmax) on the heating rotator in the axial direction thereof where the sheet Sp is conveyed.

Accordingly, even if a center of the thermal conductor in the axial direction of the heating rotator expands thermally and therefore the heating rotator contacts the thermal conductor with decreased pressure therebetween at each lateral end of the heating rotator in the axial direction thereof, the abutment contacts each lateral end of the heating rotator in the axial direction thereof, thus increasing pressure between the heating rotator and the thermal conductor substantially evenly throughout the entire axial span of the heating rotator in the axial direction thereof. The abutment does not contact an outer circumferential surface of the heating rotator in the fixing span on the heating rotator in the axial direction thereof, retaining a desired condition of the outer circumferential surface of the heating rotator in the fixing span thereon where the sheet Sp conveyed through the fixing nip N contacts the heating rotator.

The abutment presses the heating rotator against the thermal conductor at the particular position P1 with a load not smaller than about 2 N being imposed from the abutment to the heating rotator. Even if the abutment is disposed outboard from the fixing span on the heating rotator in the axial direction thereof where the heating rotator heats the sheet Sp, the heating rotator rotating in the rotation direction R2 contacts the thermal conductor which conducts heat to the heating rotator throughout the entire fixing span on the heating rotator in the axial direction thereof precisely. The abutment is resistant against temperatures not lower than about 200 degrees centigrade. Thus, the abutment is immune from earlier degradation due to overheating as the abutment contacts the heating rotator heated to an increased temperature.

The abutment contacts the heating rotator at a plurality of positions different in the axial direction of the heating rotator.

For example, two or more positions are defined in the axial direction of the heating rotator according to a contact length of the abutment contacting the heating rotator and a support condition of the abutment supported by the frame 10F. Thus, the thermal conductor conducts heat to the heating rotator evenly and sufficiently to fix the toner image Ti on the sheet Sp without increasing a driving torque of the pressure rotator.

As shown in FIGS. 4 and 7, the abutment includes an abutment portion (e.g., the abutment portions 71 and 81) and a support portion (e.g., the support portions 72 and 82). The abutment portion contacts the heating rotator frictionally. The support portion supports the abutment portion at a support position with respect to the thermal conductor.

Accordingly, the abutment portion contacting the heating rotator frictionally is supported by the support portion at the support position where the abutment portion presses the heating rotator against the thermal conductor. Additionally, the abutment portion that contacts the heating rotator is made of a flexible material having a decreased rigidity that does not damage the heating rotator and being resistant against heat and abrasion. Conversely, the support portion has a mechanical strength and a rigidity great enough to support the abutment portion at the desired support position.

As shown in FIG. 8, the abutment includes a roller type abutment portion (e.g., the friction roller 91) and a support portion (e.g., the support portion 92). The abutment portion contacts the heating rotator and is rotatable in accordance with rotation of the heating rotator. The support portion supports the abutment portion at a support position with respect to the thermal conductor.

Accordingly, the abutment portion contacting the heating rotator and being rotatable in accordance with rotation of the heating rotator is supported by the support portion at the support position where the abutment portion presses the heating rotator against the thermal conductor. Additionally, the roller type abutment includes a friction roller (e.g., the friction roller 91) that is rotatable to reduce friction between the friction roller and the heating rotator and slippage of the heating rotator as the friction roller slides over the heating rotator and is made of a material that does not damage the heating rotator, thus being immune from damaging the heating rotator. The support portion has a mechanical strength and a rigidity great enough to support the abutment portion at an appropriate position.

As shown in FIG. 7, the abutment includes an elastic plate (e.g., the elastic plate 83) that supports the abutment portion elastically.

Accordingly, the abutment including the elastic plate suppresses change in pressure with which the abutment contacts the heating rotator.

At least one of the abutment portion and the support portion is an insulator.

Accordingly, in an electrophotographic image forming process or the like, the abutment prevents a transfer electric current from being grounded through the heating rotator and the abutment, suppressing formation of a faulty toner image effectively.

As shown in FIG. 1, an image forming apparatus (e.g., the image forming apparatus 1) includes the fixing device and an image forming device (e.g., the image forming device 30) that forms the unfixed toner image Ti on the sheet Sp with a developer. As the sheet Sp bearing the toner image Ti is conveyed through the fixing device, the fixing device fixes the toner image Ti on the sheet Sp.

The thermal conductor incorporated in the fixing device conducts heat to the heating rotator evenly and sufficiently to fix the toner image Ti on the sheet Sp without increasing a load imposed on the heating rotator rotating in the rotation direction R2 and a driving torque of the pressure rotator. The image forming apparatus incorporating the fixing device that fixes the toner image Ti on the sheet Sp with an even toner density forms the high quality toner image Ti on the sheet Sp.

According to the example embodiments described above, the fixing belt 52 serves as an endless belt or a heating rotator. Alternatively, a fixing film, a fixing sleeve, or the like may be used as an endless belt or a heating rotator. Further, the pressure roller 51 serves as a pressure rotator. Alternatively, a pressure belt or the like may be used as a pressure rotator.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

an endless belt formed into a loop and rotatable in a given direction of rotation;

a heater disposed opposite the endless belt to heat the endless belt;

a thermal conductor interposed between the heater and the endless belt to conduct heat from the heater to the endless belt and guide the endless belt;

a pressure rotator pressed against the endless belt to form a fixing nip therebetween, through which a recording medium is conveyed; and an abutment contacting the endless belt to restrict a trajectory of the endless belt to bring the endless belt into contact with the thermal conductor in a particular circumferential span spanning from a particular position upstream from the fixing nip to the fixing nip in the direction of rotation of the endless belt and to separate the endless belt from the thermal conductor in at least a part of an outboard circumferential span outboard from the particular circumferential span in the direction of rotation of the endless belt.

2. The fixing device according to claim 1, wherein the abutment contacts the endless belt at the particular position to exert a resistance to rotation of the endless belt, and wherein, as the endless belt rotates in the direction of rotation, the abutment increases a tension of the endless belt in the particular circumferential span relative to a tension of the endless belt in the outboard circumferential span.

3. The fixing device according to claim 1, wherein the thermal conductor includes a rotation guide spanning the particular circumferential span and contacting the endless belt, and wherein the heater is disposed inside the loop formed by the endless belt to heat the rotation guide of the thermal conductor.

4. The fixing device according to claim 3, further comprising a reflection plate disposed inside the loop formed by the endless belt to reflect heat radiated from the heater to the rotation guide of the thermal conductor.

5. The fixing device according to claim 1, wherein the abutment contacts the endless belt in an outboard axial span on the endless belt in an axial direction thereof that is outboard from a fixing span on the endless belt in the axial direction thereof where the recording medium is conveyed.

6. The fixing device according to claim 1, wherein the abutment contacts the endless belt at a plurality of positions different in an axial direction of the endless belt.

7. The fixing device according to claim 1, wherein the abutment includes:

an abutment portion to contact the endless belt frictionally; and a support portion to support the abutment portion at a support position with respect to the thermal conductor.

8. The fixing device according to claim 7, wherein the abutment portion includes a roller to rotate in accordance with rotation of the endless belt.

9. The fixing device according to claim 8, wherein the abutment further includes a roller support bracket interposed between the roller and the support portion.

10. The fixing device according to claim 9, wherein the support portion includes:

a mount plate mounted on a frame;

a resilient plate adjoining the mount plate; and a tip adjoining the resilient plate and being mounted with the roller support bracket.

11. The fixing device according to claim 7, wherein the abutment further includes an elastic plate to support the abutment portion elastically.

12. The fixing device according to claim 7, wherein at least one of the abutment portion and the support portion includes an insulator.

13. The fixing device according to claim 7, wherein the support portion includes:

a mount plate mounted on a frame;

a resilient plate adjoining the mount plate; and an attachment face adjoining the resilient plate and being adhered with the abutment portion.

14. The fixing device according to claim 7, wherein the abutment portion is made of a material having a decreased rigidity and a decreased friction.

15. The fixing device according to claim 7, wherein the outboard circumferential span is disposed downstream from the fixing nip in the direction of rotation of the endless belt.

16. The fixing device according to claim 1, wherein the abutment restricts the trajectory of the endless belt to a restricted trajectory that is substantially circular within the particular circumferential span.

17. The fixing device according to claim 1, further comprising a nip formation pad disposed inside the loop formed by the endless belt to press against the pressure rotator to form the fixing nip.

18. The fixing device according to claim 1, wherein the pressure rotator includes a pressure roller.

19. An image forming apparatus comprising:

an image forming device to form a toner image; and a fixing device, disposed downstream from the image forming device in a recording medium conveyance direction, to fix the toner image on a recording medium, the fixing device including:

an endless belt formed into a loop and rotatable in a given direction of rotation;

a heater disposed opposite the endless belt to heat the endless belt;

a thermal conductor interposed between the heater and the endless belt to conduct heat from the heater to the endless belt and guide the endless belt;

a pressure rotator pressed against the endless belt to form a fixing nip therebetween, through which the recording medium is conveyed; and an abutment contacting the endless belt to restrict a trajectory of the endless belt to bring the endless belt into contact with the thermal conductor in a particular circumferential span spanning from a particular position upstream from the fixing nip to the fixing nip in the direction of rotation of the endless belt and to separate the endless belt from the thermal conductor in at least a part of an outboard circumferential span outboard from the particular circumferential span in the direction of rotation of the endless belt.

* * * * *